US006938303B2

(12) United States Patent
Watson et al.

(10) Patent No.: US 6,938,303 B2
(45) Date of Patent: Sep. 6, 2005

(54) DOUBLE PIVOT CONCEALED HINGE

(75) Inventors: Earl L Watson, Walled Lake, MI (US); Krzysztof Michalowski, Livonia, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 10/691,876

(22) Filed: Oct. 22, 2003

(65) Prior Publication Data

US 2005/0086770 A1 Apr. 28, 2005

(51) Int. Cl.[7] ..... E05D 11/10

(52) U.S. Cl. ..... 16/334; 16/335; 16/366; 16/247; 16/324

(58) Field of Search ..... 16/334, 228, 229, 16/302, 303, 323, 335, 341, 308, 288, 82, 16/297, 86 C, 377, 366, 365, 287, 296, 324

(56) References Cited

U.S. PATENT DOCUMENTS

| | | | | | |
|---|---|---|---|---|---|
| 452,685 | A | * | 5/1891 | Webster | 4/236 |
| 2,870,477 | A | * | 1/1959 | Anthony et al. | 16/321 |
| 3,065,497 | A | * | 11/1962 | Faber | 16/334 |
| 3,370,317 | A | * | 2/1968 | Marchione | 16/308 |
| 3,729,772 | A | * | 5/1973 | Marchione | 16/334 |
| 4,266,321 | A | * | 5/1981 | Pelchat et al. | 16/335 |
| 4,285,098 | A | * | 8/1981 | Hicks et al. | 16/308 |
| 4,672,715 | A | * | 6/1987 | Beckwith | 16/334 |
| 4,719,665 | A | * | 1/1988 | Bell | 16/232 |
| 4,744,127 | A | * | 5/1988 | Shadley | 16/232 |
| 5,491,875 | A | * | 2/1996 | Siladke et al. | 16/346 |
| 5,561,887 | A | | 10/1996 | Neag et al. | |
| 5,570,498 | A | * | 11/1996 | Hipkiss et al. | 16/258 |
| 5,575,037 | A | * | 11/1996 | Tolle et al. | 16/334 |
| 5,632,065 | A | * | 5/1997 | Siladke et al. | 16/335 |
| 5,685,046 | A | * | 11/1997 | Neag et al. | 16/366 |
| 6,038,738 | A | * | 3/2000 | Neag et al. | 16/324 |
| 6,053,561 | A | | 4/2000 | Hojnowski et al. | |
| 6,149,222 | A | | 11/2000 | Schambre et al. | |
| 6,550,845 | B1 | | 4/2003 | Pietryga | |
| 6,606,763 | B1 | | 8/2003 | Brückner | |
| 6,609,748 | B1 | | 8/2003 | Azzouz et al. | |

(Continued)

FOREIGN PATENT DOCUMENTS

GB 2203483 A * 10/1988 ..... E05D 3/06

*Primary Examiner*—Chuck Y Mah
*Assistant Examiner*—Mark Williams
(74) *Attorney, Agent, or Firm*—Ralph E. Smith

(57) ABSTRACT

A dual pivot hinge for a vehicle door includes a door side hinge support, and a body side hinge support, connected by a hinge arm. The door side hinge support includes a cam surface terminating in a detent. A rocker arm is pivotally mounted to the hinge arm, and includes a roller that is biased against the cam surface of the door side hinge support. A stop link is pivotally mounted between the body side hinge support and the hinge arm. To open the door, the door side hinge support pivots about the hinge arm until the roller of the rocker arm engages the detent. As the door opens further, the hinge arm pivots on the body side hinge support. The stop link prevents the hinge arm from over-rotating, and a roller and torsion rod arrangement prevents the door from inadvertently closing. Closing the door follows the reverse sequence.

7 Claims, 7 Drawing Sheets

U.S. PATENT DOCUMENTS 6,629,337 B2 10/2003 Nania
6,681,448 B2 * 1/2004 Liang ..... 16/336
6,842,945 B2 * 1/2005 Hiramatsu ..... 16/366
2003/0056323 A1 3/2003 Liang et al.

* cited by examiner

DOUBLE PIVOT CONCEALED HINGE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The invention relates to vehicle doors capable of opening further than ninety degrees. In another of its aspects the invention relates to multiple pivot hinge mechanisms.

2. Description of Related Art

Automobiles have side doors for occupant entry that generally pivot out from the automobile at an angle approaching ninety degrees. These doors are usually attached to the automobile at a leading edge of the door and door opening.

In certain applications, specifically in pickup trucks having an oversized cab, a second door is mounted to the trailing edge of the door opening. The two doors cooperate to fill the door opening. It has been found, however, that when the second door only opens to ninety degrees, access to the interior of the truck cab, particular in close quarters, is restricted.

It would be advantageous to develop a hinge mechanism for a vehicle door that allows the door to pivot further than ninety degrees, and preferably to pivot flat against the vehicle exterior, to enable ready access to the interior of the vehicle.

BRIEF SUMMARY OF THE INVENTION

A dual pivot concealed hinge mechanism comprises a body side hinge support having a stop pin, a door side hinge support having a cam surface, the cam surface terminating in a detent, and a U-shaped hinge arm pivotally connected to the body side hinge support and the door side hinge support and including a rocker arm pivotally mounted to the hinge arm and having a cam follower biased against the cam surface, and a stop linkage pivotally connected between the hinge arm and the body side hinge support, whereby the hinge mechanism is adapted to operate through a substantially semi-circular range of motion, a first portion of the range of motion pivoting the door side hinge support relative to the hinge arm as the cam follower traverses the cam surface, until the cam follower engages the detent, and a second portion of the range of motion pivoting the hinge arm relative to the body side hinge support until the stop linkage engages the stop pin.

In a further embodiment of the hinge mechanism, the body side hinge support further comprises a torsion rod having a reaction leg, and the stop linkage further comprises a roller adapted to engage the reaction leg. The stop linkage can include a bell crank arm pivotally mounted to the body side hinge support, with the roller mounted on the bell crank arm. The stop linkage is biased against the stop pin by the reaction leg.

BRIEF DESCRIPTION OF THE SEVERAL VIEWS OF THE DRAWINGS

The present invention will become more fully understood from the detailed description and the accompanying drawings, wherein.

DETAILED DESCRIPTION OF THE INVENTION

Figure 1:
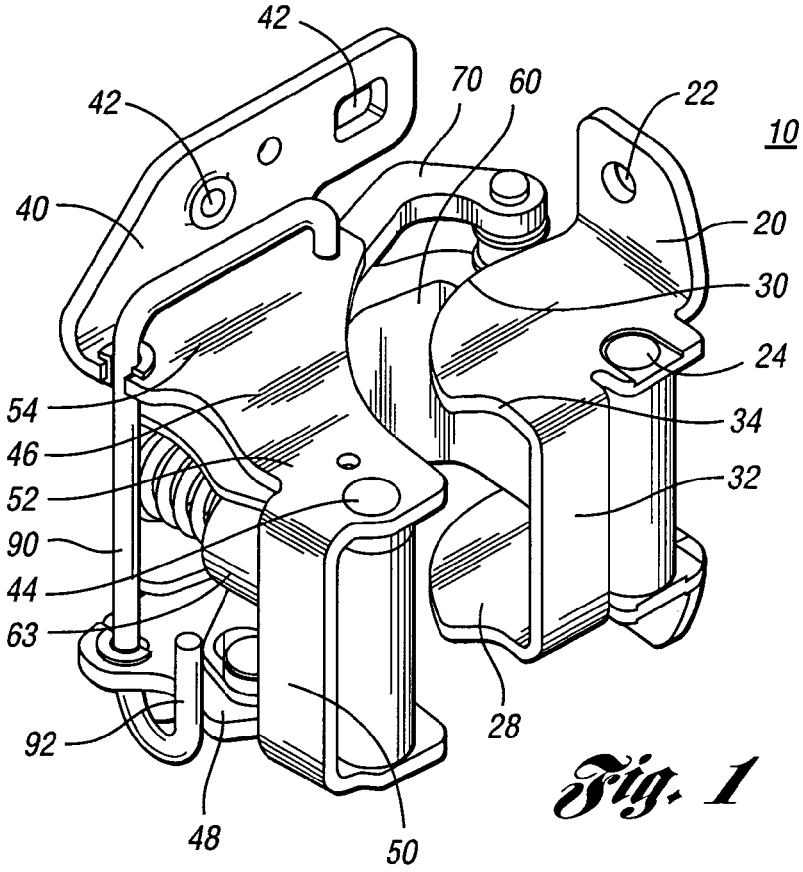
FIG. 1 is a perspective view of a dual pivot hinge according to the invention in a closed position.
Figure 3:
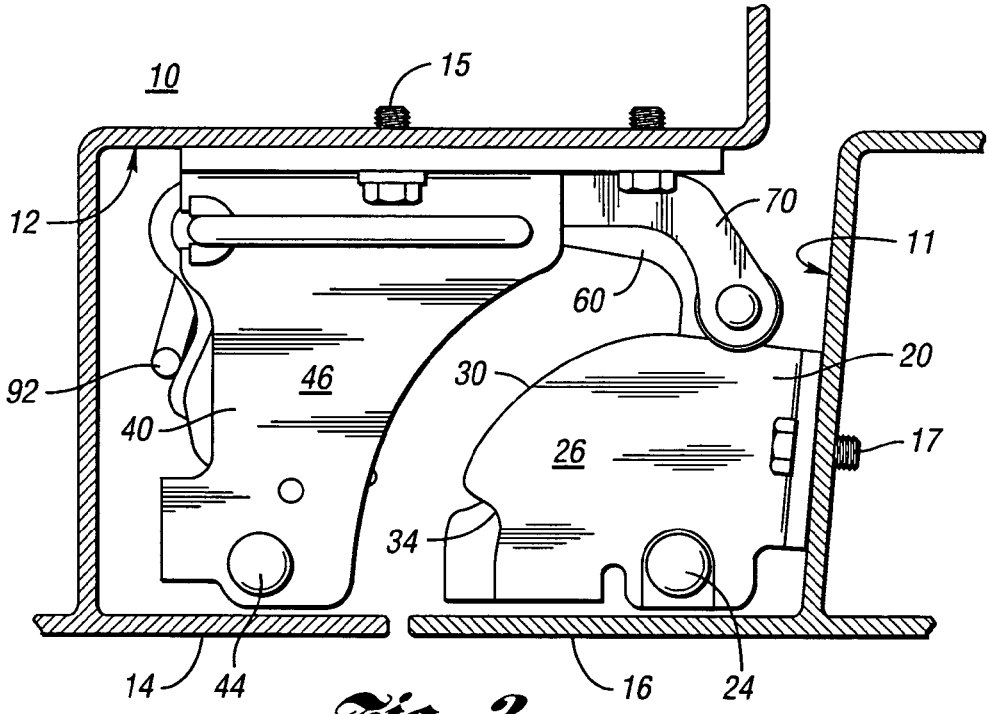
FIG. 3 is a plan view of the dual pivot hinge of FIGS. 1–2 in the closed position.
Figure 2:
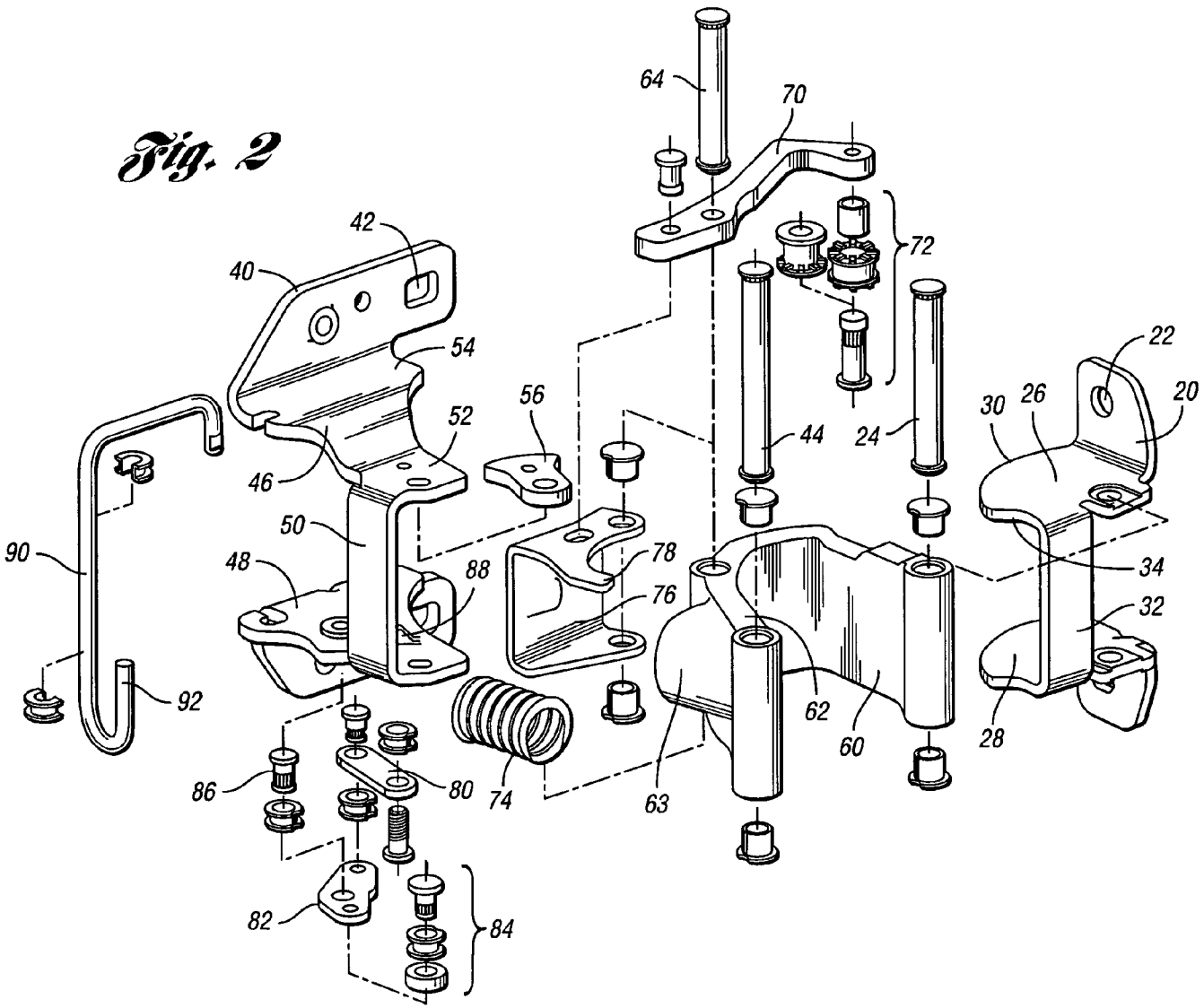
FIG. 2 is an exploded perspective view of the dual pivot hinge of FIG. 1.

Referring to FIGS. 1–3, a dual pivot hinge mechanism 10 according to the invention generally comprises a door side hinge support 20, a body side hinge support 40, and a substantially U-shaped hinge arm 60 pivotally connected to each of the hinge supports 20, 40. FIGS. 1 and 3–5 illustrate the hinge mechanism 10 in the closed position. As shown in FIG. 3, the vehicle exterior skin will conceal the hinge mechanism 10.

Door side hinge support 20 is adapted to be secured to a concealed face 11 of a vehicle door 16 by fasteners 17 inserted through apertures 22. Body side hinge support 40 is adapted to be secured to a concealed, outwardly directed face 12 of the vehicle body 14 by fasteners 15 inserted through apertures 42. Hinge arm 60 is pivotally mounted to door side hinge support 20 by door side hinge pin 24 and to body side hinge support 40 by body side hinge pin 44.

Door side hinge support 20 includes upper and lower flanges 26, 28, at least one of which has a cam edge 30. Upper and lower flanges 26, 28 are connected by a bridge portion 32 parallel to hinge pin 24.

Body side hinge support 40 includes upper and lower flanges 46, 48 connected by bridge portion 50. Upper flange 46 is stepped from a lower section 52 to an upper section 54.

Figure 4:
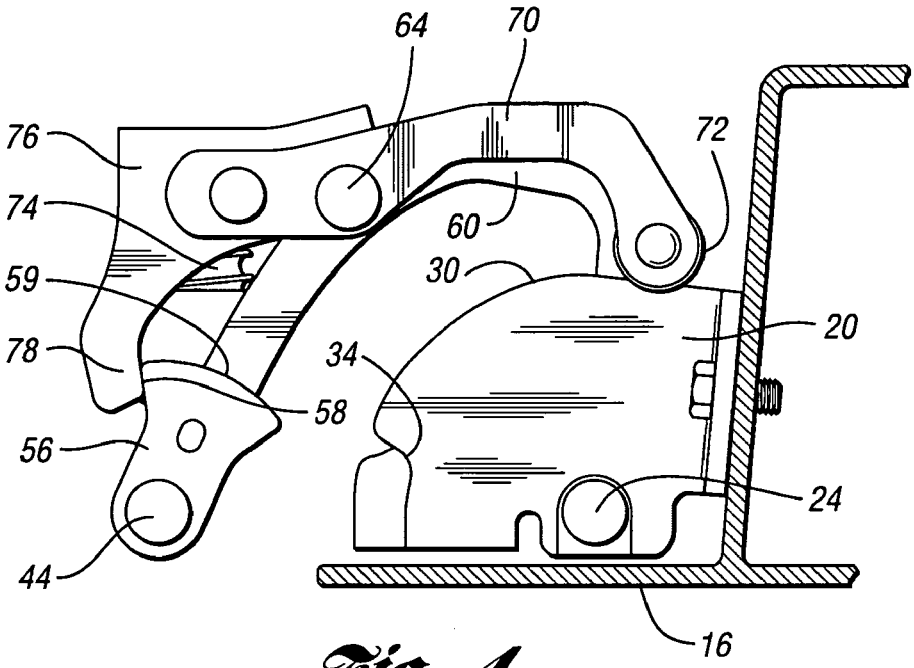
FIG. 4 is a partial cutaway plan view of the dual pivot hinge of FIGS. 1–3 in the closed position.
Figure 5:
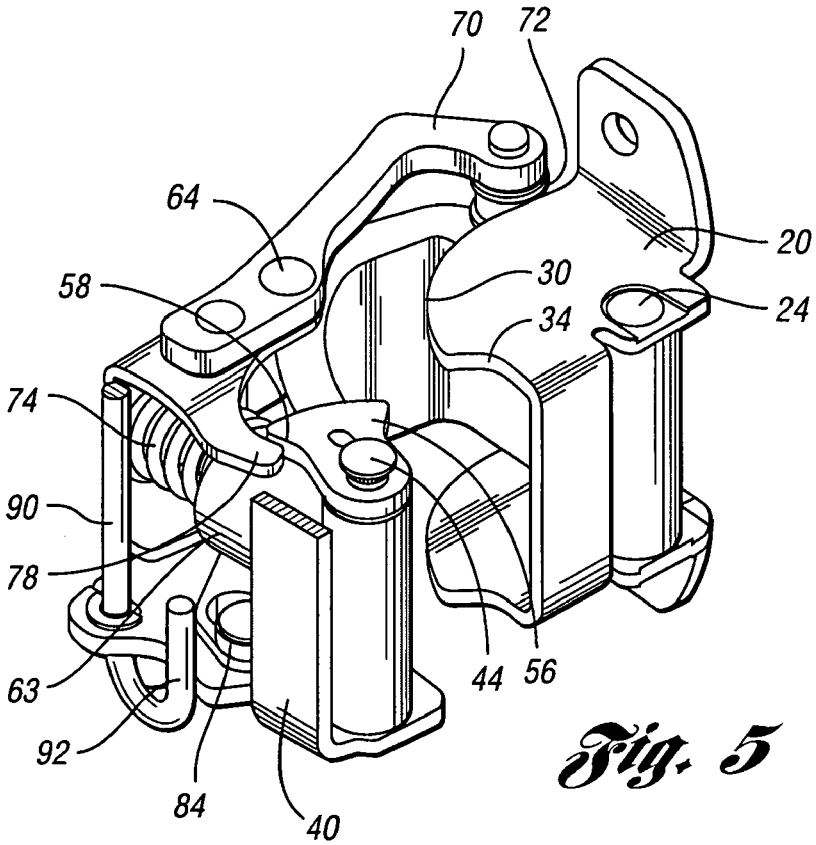
FIG. 5 is a partial cutaway perspective view of the dual pivot hinge of FIGS. 1–4 in the closed position.
Figure 6:
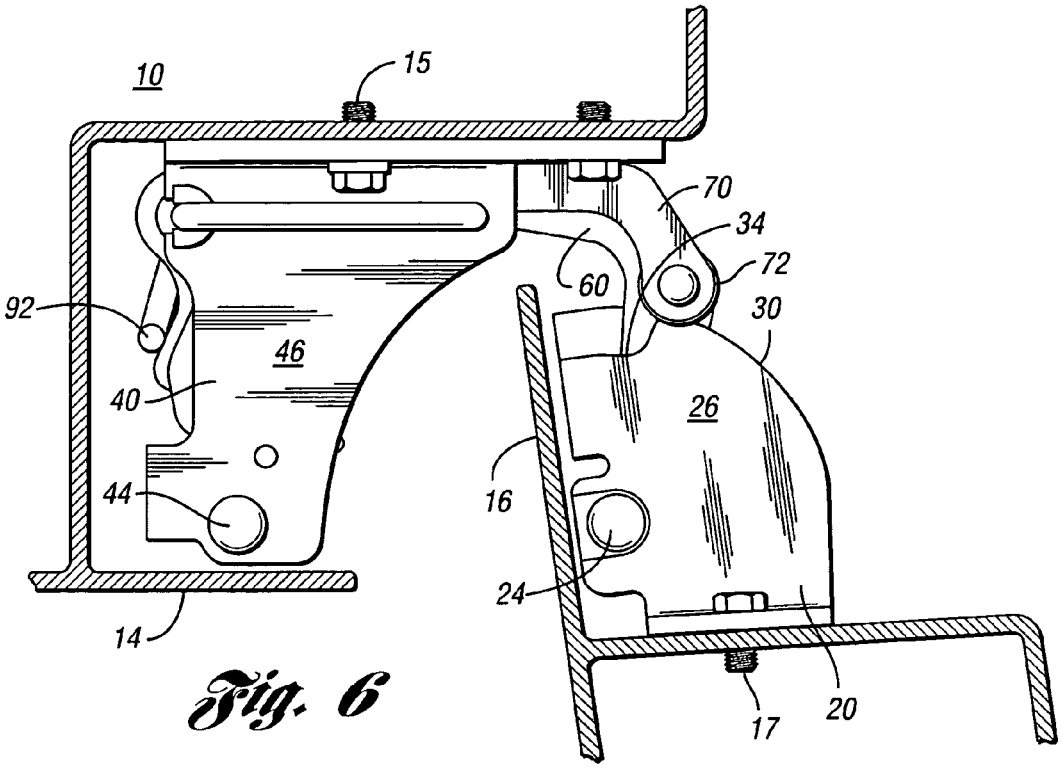
FIG. 6 is a plan view of the dual pivot hinge of FIGS. 1–5 in a partially open position.
Figure 7:
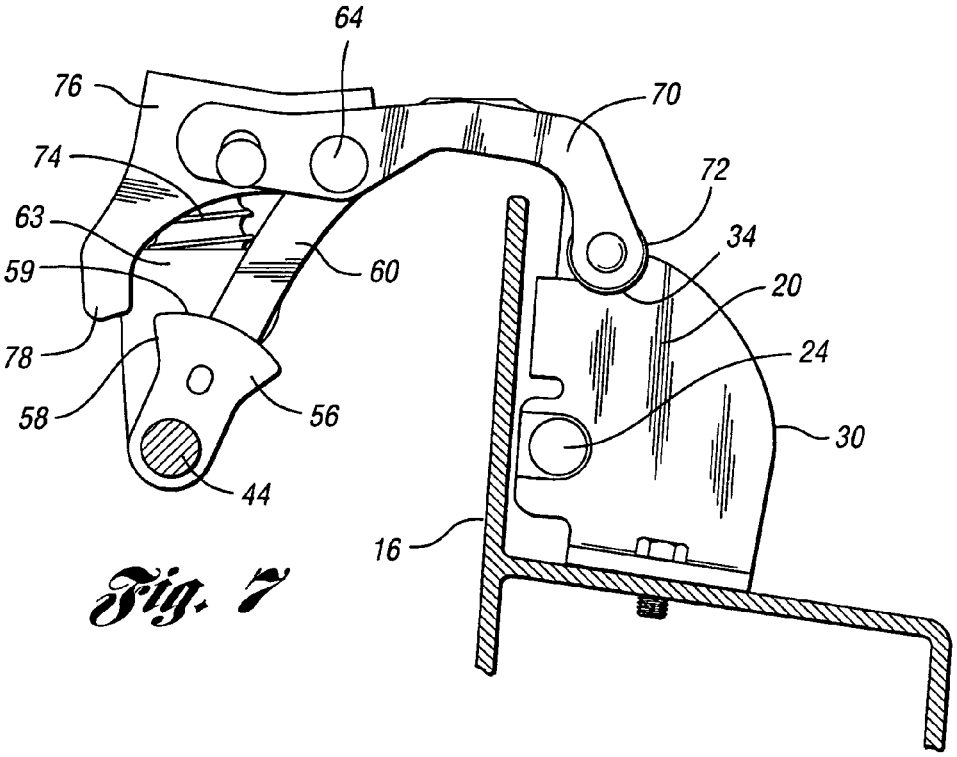
FIG. 7 is a partial cutaway plan view of the dual pivot hinge of FIGS. 1–6 in a partially open position.

With particular reference to FIGS. 2 and 4–5, a rocker arm 70 is pivotally mounted to an upper surface 62 of hinge arm 60 by a pivot pin 64. Rocker arm 70 includes a cam follower 72 at one end, arranged to bear against cam edge 30. Rocker arm 70 is further mounted to rocker arm bracket 76, which is also pivotally mounted to hinge arm 60. Rocker arm 70 and bracket 76 are biased by compression spring 74 operably positioned between a pocket 63 on hinge arm 60 and bracket 76. As a result, cam follower 72 is biased into contact with cam edge 30.

FIG. 4 is a plan view of the hinge assembly 10, with body side hinge support 40 cut away. A bell-shaped stop 56 is fixed against rotation to upper flange 46 of body side hinge support 40. Rocker arm bracket 76 includes a retainer arm 78 that extends into body side hinge support 40 so as to engage a face 58 of stop 56 when cam follower 72 bears against cam edge 30. Hinge arm 60 is thereby prevented from rotating with respect to body side hinge support 40 about hinge pin 44.

At the body side hinge support 40, a link 80 and bell crank arm 82 form a pivotal linkage between hinge arm 60 and lower flange 48. Lower flange 48 further comprises a pivot stop 88 functionally positioned relative to bell crank arm 82.

A star-wheeled roller bearing 84 is mounted on bell crank arm 82 at an opposing end to link 80. A torsion rod 90 is mounted on body side hinge support 40. Torsion rod 90 includes a reaction leg 92 positioned proximate lower flange 48 of body side hinge support 40 and arranged to interact with star-wheeled roller bearing 84 during pivoting operation of the hinge mechanism 10 about hinge pin 44.

Referring now to FIGS. 3–9, the hinge mechanism 10 is configured to operate in a specific sequential manner. FIG. 3 depicts hinge mechanism 10 in a closed position. Hinge arm 60 is nested substantially within body side hinge support 40 and door side hinge support 20. As a force is applied opposite hinge mechanism 10 to open the vehicle door 16, door side hinge support 20 rotates in a clockwise direction (in reference to the orientation of FIG. 3), pivoting about hinge pin 24 as cam follower 72 travels along cam edge 30.

As door side hinge support 20 pivots about hinge pin 24, hinge arm 60 is prevented from rotating about hinge pin 44 by retainer arm 78 engaging face 58 of stop 56. As door side hinge support 20 reaches the partially open position shown in FIG. 7, cam follower 72 enters detent 34, which is recessed relative to the arcuate cam edge 30. Door side hinge support 20 is prevented from rotating further about hinge pin 24 as hinge arm 60 contacts bridge portion 32.

As cam follower 72 enters detent 34, rocker arm 70 can rotate about pin 64, and is biased to do so by compression spring 74. Cam follower 72, biased into detent 34 by spring 74, provides resistance against door side hinge support 20 inadvertently returning to the closed position, thereby acting as a door check for the first portion of the door opening rotation.

As rocker arm 70 and rocker arm bracket 76 rotate about pin 64, retainer arm 78 is retracted away from face 58 of stop 56. This occurs with a rotation of door side hinge support 20 about hinge pin 24 of approximately 80–100 degrees.

As the vehicle door 16 is urged toward opening further, hinge arm 60, now released to rotate about hinge pin 44, begins to pivot relative to body side hinge support 40. Retainer arm 78 is clear to travel about bell-shaped stop 56 along arcuate face 59.

Figure 9:
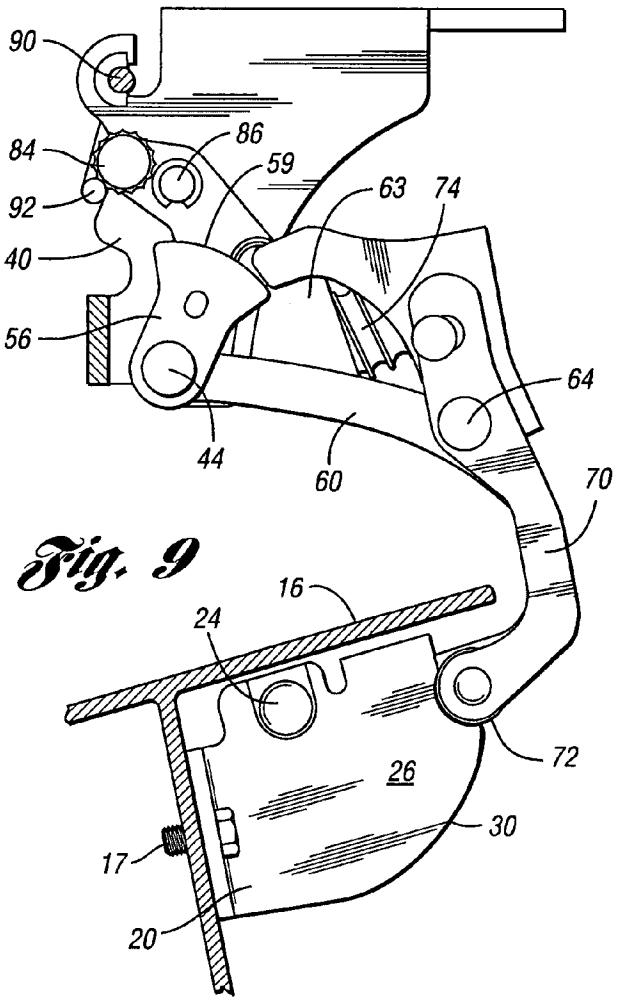
FIG. 9 is a partial cutaway plan view of the dual pivot hinge of FIGS. 1–8 in an open position.
Figure 8:
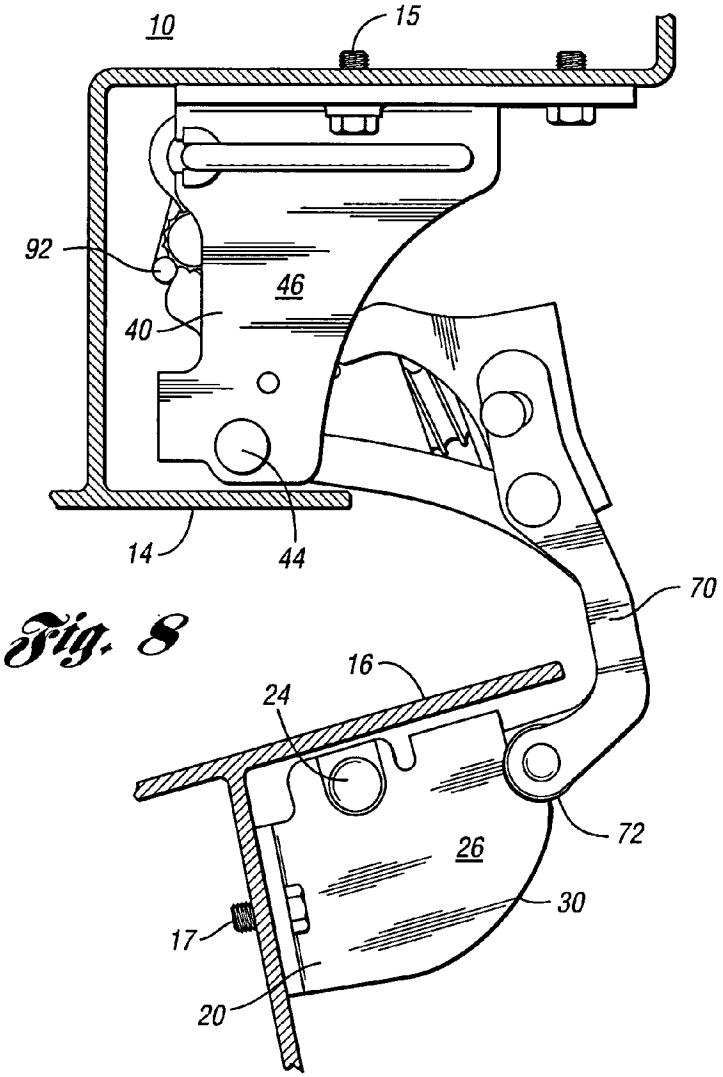
FIG. 8 is a plan view of the dual pivot hinge of FIGS. 1–7 in an open position.

Referring now to FIGS. 8–9, as hinge arm 60 pivots relative to body side hinge support 40, the linkage formed by link 80 and bell crank arm 82 extends, causing bell crank arm 82 to pivot about pin 86. Hinge arm 60 reaches its limit of rotation as bell crank arm 82 contacts pivot stop 88 (see FIG. 2) on lower flange 48. Link 80 and bell crank arm 82 thereby prevent hinge arm 60 from over-rotating.

As bell crank arm 82 rotates when drawn by link 80, star-wheeled roller bearing 84 presses against reaction leg 92 of torsion rod 90. Reaction leg 92 is deflected by star-wheeled roller bearing 84 so that roller bearing 84 can pass by reaction leg 92, which then rebounds behind roller bearing 84. The assembly is configured such that bell crank arm 82 is biased by reaction leg 92 against pivot stop 88. Reaction leg 92 and bell crank arm 82 thus provide resistance against hinge arm 60 rotating counterclockwise toward the closed position.

In order for the vehicle door to be closed, a force exceeding the biasing force of reaction leg 92 on star-wheeled roller bearing 84 and bell crank arm 82 must be exerted on the door. Torsion rod 90, reaction leg 92, and bell crank arm 82 are configured so that the force required to overcome the bias of the reaction leg 92 against star-wheeled roller bearing 84 is less than the force required to dislodge cam follower 72 from detent 34. The pivoting action of the hinge arm 60 about hinge pin 44 will therefore occur first when the vehicle door is being closed. After hinge arm 60 rotates to its fully nested position in body side hinge support 40, additional force exerted on the vehicle door will act to dislodge cam follower 72 from detent 34, and then continue to move the door to the closed position as cam follower 72 traverses cam edge 30.

In the event of a failure of compression spring 74 or reaction leg 92, the hinge mechanism is still prevented from closing out of sequence. During the opening sequence, hinge arm 60 is prevented from rotating relative to body side hinge support 40 because retainer arm 78 is positioned against face 58 by rocker arm 70. Upon entry of cam follower 72 into detent 34, rocker arm bracket 76 rotates and retainer arm 78 is released from face 58. As hinge arm 60 rotates relative to body side hinge support 40, retainer arm 78 closely traverses arcuate face 59 of stop 56, as shown particularly in FIG. 9. Cam follower 72 is further retained in detent 34 because any attempt to rotate rocker arm 70 and rocker arm bracket 76 is defeated when retainer arm 78 contacts arcuate face 59 of stop 56. Rocker arm 70 is thus prevented from rotating until the hinge arm 60 is returned to the fully nested position with body side hinge support 40 and retainer arm 78 is aligned with face 58 of stop 56.

Figure 10:
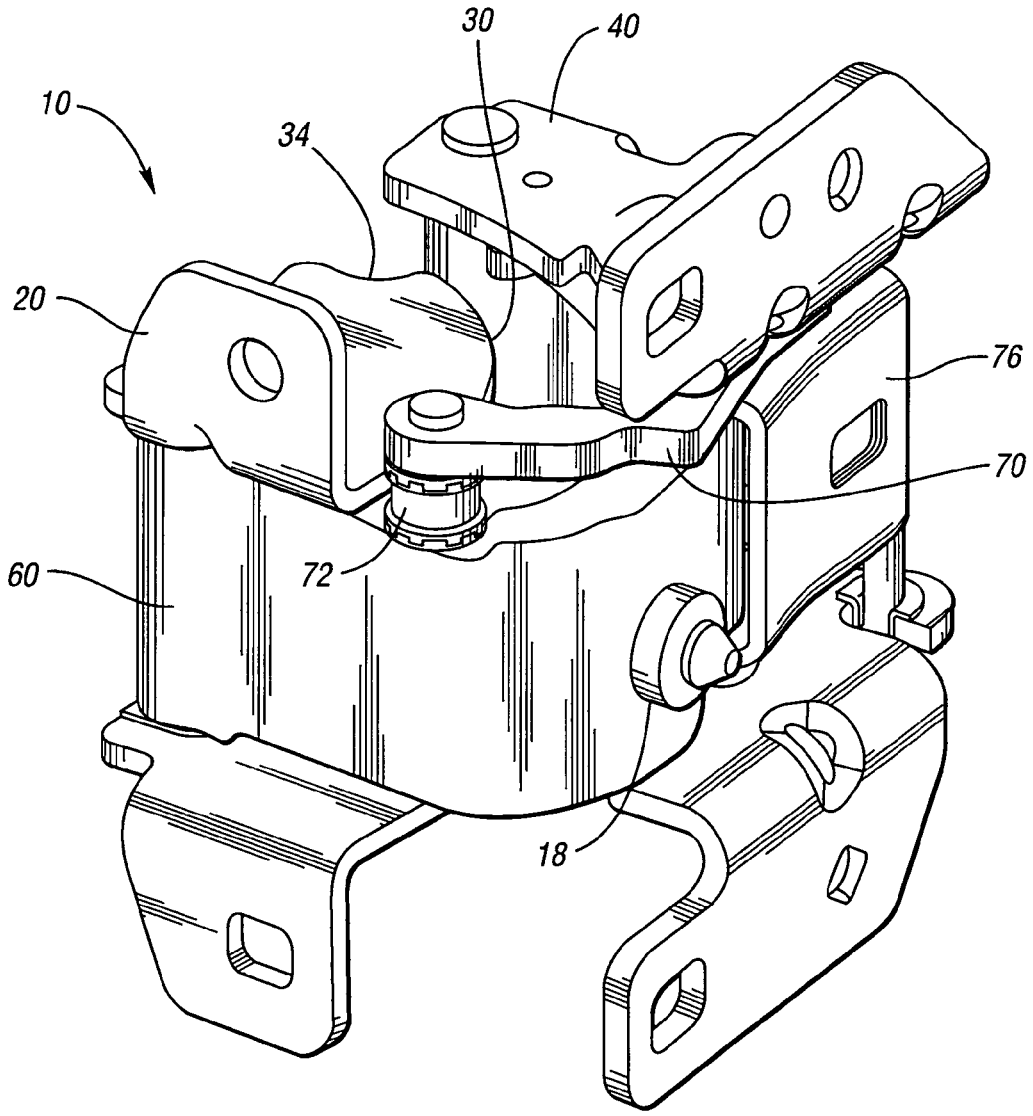
FIG. 10 is a reverse perspective view of the dual pivot hinge of FIGS. 1–9.

FIG. 10 is a reverse perspective view of the hinge mechanism 10 shown in FIGS. 1–9. A bumper 18 is shown in a position where it will keep hinge arm 60 separated from vehicle body 14 when the hinge arm 60 is in the closed position nested within body side hinge support 40. The bumper 18 can be attached to either the hinge arm 60 or the vehicle body 14 to effect the separation.

The bumper 18 is useful to prevent the hinge arm 60 from striking vehicle body 14 and particularly prevents the rocker arm 70 from contacting vehicle body 14. If rocker arm 70 contacts vehicle body 14, cam follower 72 could become jammed in detent 34, preventing door side hinge support 20 from rotating relative to hinge arm 60, and preventing the vehicle door from being closed. A further function of bumper 18 is to serve as a noise and vibration damper, and, in concert with vehicle doors seals (not shown), to account for tolerances within the hinge mechanism 10 when the vehicle door 16 is closed.

Figure 11:
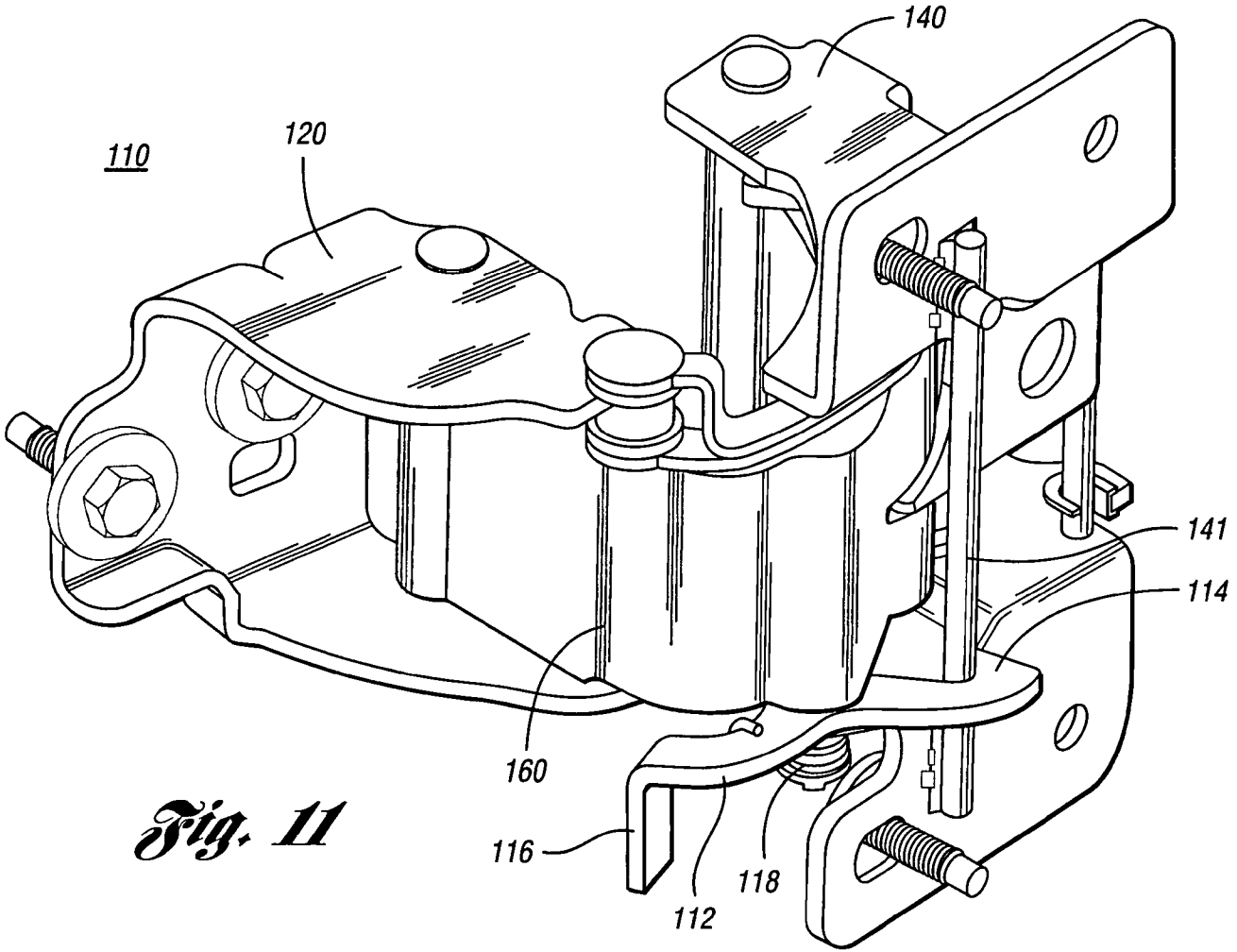
FIG. 11 is a reverse perspective view of a dual pivot hinge according to a further embodiment of the invention.

A further embodiment of a hinge mechanism 110 according to the invention is depicted in FIG. 11. The hinge mechanism 110 differs from the hinge mechanism 10 in that hinge arm 160 is positively locked in position within body side hinge support 140 by a separate latch mechanism 112. Latch mechanism 112 is pivotally mounted to hinge 170 and comprises a hook 114 spring biased so as to engage a striker 141 on body side hinge support 140 with hinge 110 in the nested/closed position.

FIG. 11 shows the door side hinge support 120 in its fully open position. In order for the vehicle door to be opened any further, hook 114 must be manually disengaged from striker 141. The figure depicts latch mechanism 112 having a release lever 116 immediately accessible at the hinge mechanism 110, although it is also anticipated that the latch mechanism 112 can be configured to be released from a remote location.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the scope of the appended claims.

What is claimed is:

1. A dual pivot concealed hinge mechanism comprising:

a body side hinge support comprising:

a pivot stop;

a door side hinge support having a cam surface, the cam surface terminating in a detent; and a U-shaped hinge arm pivotally connected to the body side hinge support and the door side hinge support, and comprising:

a rocker arm pivotally mounted to the hinge arm and having a cam follower biased against the cam surface; and a stop linkage pivotally connected between the hinge arm and the body side hinge support, wherein the body side hinge support further comprises a torsion rod having a reaction leg, and the stop linkage further comprises a roller, the roller adapted to engage the reaction leg; and whereby the hinge mechanism is adapted to operate through a substantially semi-circular range of motion, a first portion of the range of motion pivoting the door side hinge support relative to the hinge arm as the cam follower traverses the cam surface, until the cam follower engages the detent, and a second portion of the range of motion pivoting the hinge arm relative to the body side hinge support until the stop linkage engages the pivot stop.

2. The hinge mechanism of claim 1, wherein the stop linkage comprises a bell crank arm pivotally mounted to the body side hinge support, and the roller is mounted on the bell crank arm.

3. The hinge mechanism of claim 1, wherein the stop linkage is biased against the pivot stop by the reaction leg.

4. A dual pivot hinge mechanism for a vehicle door, adapted to pivot the vehicle door about a substantially semi-circular arc, wherein the door pivots through a first portion of the arc about a first pivot pin mounted in a first hinge support and pivots through a second portion of the arc about a second pivot pin mounted in a second hinge support, the hinge mechanism further comprising:

the first hinge support comprising a cam surface corresponding to a first portion of the arc and terminating a detent position;

the second hinge support comprising a pivot stop; and a torsion rod having a reaction leg, a hinge arm pivotally connecting the first and second pivot pins;

a cam follower mounted to the hinge arm, the cam follower being biased against the cam surface; and a stop linkage operably connecting the hinge arm to the second hinge support and adapted to engage the pivot stop to limit rotation of the hinge arm about the second pivot pin and the stop linkage further comprises a roller, the roller adapted to engage the reaction leg.

5. The hinge mechanism of claim 4, wherein the stop linkage comprises a bell crank arm pivotally mounted to the second hinge support, and the roller is mounted on the bell crank arm.

6. The hinge mechanism of claim 4, wherein the stop linkage is biased against the pivot stop by the reaction leg.

7. The hinge mechanism of claim 4, further comprising a rocker arm pivotally mounted to the hinge arm, the cam follower being mounted on the rocker arm.

* * * * *

UNITED STATES PATENT AND TRADEMARK OFFICE

CERTIFICATE OF CORRECTION

PATENT NO. : 6,938,303 B2 
DATED : September 6, 2005
INVENTOR(S) : Earl L. Watson and Krzysztof Michalowski It is certified that error appears in the above-identified patent and that said Letters Patent is hereby corrected as shown below:

Title page,
Item [75], Inventors, add:
-- Daniel W. Husted, Saline, MI (US)
Dorinel Neag, Walled Lake, MI (US)
Bruce P. Mattarella, Canton, MI (US)
Stylianos A. Meidanis, West Bloomfield, MI (US) --.

Signed and Sealed this

Thirty-first Day of January, 2006

JON W. DUDAS
*Director of the United States Patent and Trademark Office*